US007135811B2

(12) United States Patent
Scholz et al.

(10) Patent No.: US 7,135,811 B2
(45) Date of Patent: Nov. 14, 2006

(54) SHROUD HOLDER FOR QUARTZ AND CERAMIC ARC TUBES

(75) Inventors: John A. Scholz, Georgetown, MA (US); Peter R. Ness, Hampton, NH (US)

(73) Assignee: Osram Sylvania Inc., Danvers, MA (US)

( * ) Notice: Subject to any disclaimer, the term of this patent is extended or adjusted under 35 U.S.C. 154(b) by 128 days.

(21) Appl. No.: 11/053,143

(22) Filed: Feb. 8, 2005

(65) Prior Publication Data

US 2006/0175948 A1 Aug. 10, 2006

(51) Int. Cl.
*H01J 1/18* (2006.01)
*H01J 19/00* (2006.01)

(52) U.S. Cl. ..... 313/238; 313/269; 313/292

(58) Field of Classification Search ..... 313/238, 313/243, 269, 292, 25
See application file for complete search history.

(56) References Cited

U.S. PATENT DOCUMENTS 4,281,274 A * 7/1981 Bechard et al. ..... 315/49
4,499,396 A * 2/1985 Fohl et al. ..... 313/25
4,580,989 A * 4/1986 Fohl et al. ..... 445/26
5,136,204 A 8/1992 Muzeroll

* cited by examiner

*Primary Examiner*—Ashok Patel
(74) *Attorney, Agent, or Firm*—William E. Meyer

(57) ABSTRACT

A multi-functional shroud/arc tube support or clip (40*a*) for a high intensity discharge lamp (10). The support (40*a*) has one end (42) formed to engage a shroud (20). The one end (42) is formed as an arcuate member (43). A middle portion (44) is formed of separated, depending legs (46, 48) defining a space (50) therebetween for clasping the substantially rectangular pinch seal (52) of a quartz arc tube (14). The central section (53) is formed to clasp the cylindrical capillary (54) of a ceramic arc tube (14*a*). The central section (53) comprises the bight of a pair of U-shaped legs and the bights are provided with opposing, substantially hemi-cylindrical concavities (53*a*).

2 Claims, 5 Drawing Sheets

SHROUD HOLDER FOR QUARTZ AND CERAMIC ARC TUBES

TECHNICAL FIELD

This invention relates to metal halide arc discharge lamps and more particularly to such lamps utilizing arc tubes of quartz or alumina in conjunction with a shroud. More particularly, it relates to clips that hold and center the arc tube within the shroud.

BACKGROUND ART

Metal halide arc discharge lamps are frequently employed in commercial usage because of their high luminous efficacy and long life. A typical metal halide arc discharge lamp includes a quartz or fused silica arc tube that is hermetically sealed within a borosilicate glass outer envelope. The arc tube, itself hermetically sealed, has tungsten electrodes sealed into opposite ends and contains a fill material including mercury, metal halide additives and a rare gas to facilitate starting. In some cases, particularly in high wattage lamps, the outer envelope is filled with nitrogen or another inert gas at less than atmospheric pressure. In other cases, particularly in low wattage lamps, the outer envelope is evacuated.

Another type of metal halide lamp uses a ceramic arc tube having a more or less bulbous body with cylindrical capillaries projecting therefrom. The capillaries contain the electrode feed-throughs.

It has been found desirable to provide metal halide arc discharge lamps of either type with a shroud that comprises a generally cylindrical, light-transmissive member, such as quartz, that is able to withstand high operating temperatures. The arc tube and the shroud are coaxially mounted within the lamp envelope with the arc tube located within the shroud. Preferably, the shroud is a tube that is open at both ends. In other cases, the shroud is open on one end and has a domed configuration on the other end. Shrouds for metal halide arc discharge lamps are disclosed in U.S. Pat, No. 4,499,396 issued Feb. 12, 1985 to Fohl et al. and U.S. Pat. No. 4,580,989 issued Apr. 8, 1986 to Fohl et al. See also U.S. Pat. No. 4,281,274 issued Jul. 28, 1981 to Bechard et al.

The shroud has several beneficial effects on lamp operation. In lamps with a gas-filled outer envelope, the shroud reduces convective heat losses from the arc tube and thereby improves the luminous output and the color temperature of the lamp. In lamps with an evacuated outer envelope, the shroud helps to equalize the temperature of the arc tube. In addition, the shroud effectively reduces sodium losses and improves the maintenance of phosphor efficiency in metal halide lamps having a phosphor coating on the inside surface of the outer envelope. Finally, the shroud improves the safety of the lamp by acting as a containment device in the event that the arc tube shatters.

Specially designed clips mount the arc tube and the shroud within the outer envelope. In the past it has been necessary to utilize different clip designs for quartz arc tubes, which have a more or less rectangular pinch -seal at the ends and the ceramic type, which have cylindrical capillaries terminating the arc tube.

It would be an advance in the art if a single clip could provide support for either type of arc tube, since such a clip would substantially reduce inventory and parts requirements.

DISCLOSURE OF INVENTION

It is, therefore, an object of the invention to obviate the disadvantages of the prior art.

It is another object of the invention to enhance the manufacture of metal halide arc discharge lamps.

Still another object of the invention is a reduction in the number of parts necessary to be kept in inventory.

Yet another object of the invention is the provision of a shroud/arc tube clip that can be utilized for either quartz arc tubes or ceramic arc tubes.

These objects are accomplished, in one aspect of the invention, by the provision of a multi-functional shroud/arc tube support for a high intensity discharge lamp, said support comprising: at least one end formed to engage a shroud; and a middle portion formed of separated, depending legs defining a space therebetween for clasping the substantially rectangular pinch seal of a quartz arc tube and having a central section formed to clasp the cylindrical capillary of a ceramic arc tube.

By providing a clip support that can be used with either a quartz arc tube or a ceramic arc tube, the number of parts necessary to be inventoried is reduced and lamp assembly is greatly enhanced.

BEST MODE FOR CARRYING OUT THE INVENTION

For a better understanding of the present invention, together with other and farther objects, advantages and capabilities thereof, reference is made to the following disclosure and appended claims taken in conjunction with the above-described drawings.

Figure 1:
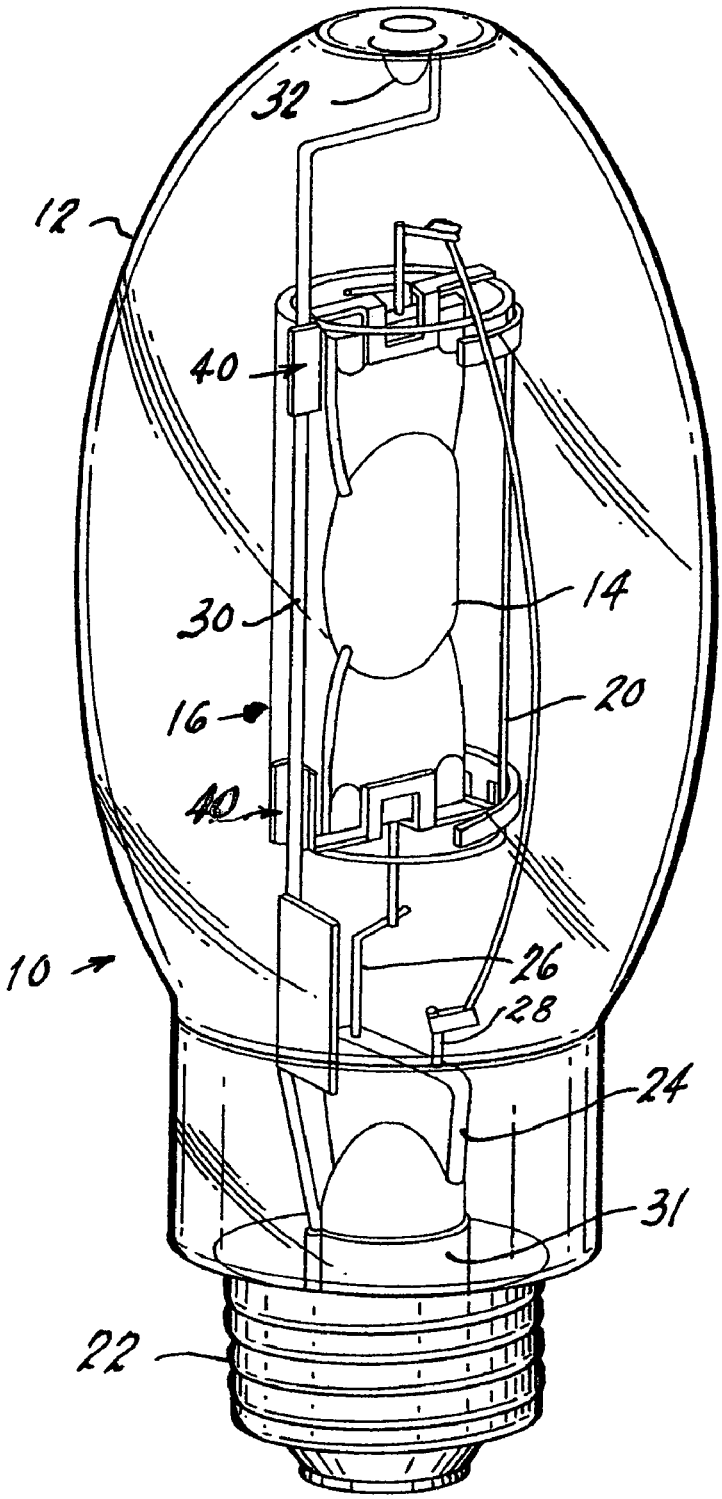
FIG. 1 Prior Art
FIG. 1 is a perspective view of a prior art arc discharge lamp employing a previous support clip.

Referring now to the drawings with greater particularity, there is shown in FIG. 1 a prior art metal halide arc discharge lamp 10 including a lamp envelope 12 and an arc tube 14 mounted within the envelope by mounting frame 16. The arc tube is positioned within a shroud 20 which can also be supported by the mounting frame 16. Electrical energy is coupled to the arc tube 14 through a base 22 a lamp stem 24 and electrical leads 26 and 28 sealed into the stem 24. The arc tube contains a chemical fill or dose of materials to provide light when an arc is initiated therein, as is known. The shroud 20 comprises a cylindrical tube of light transmissive, heat resistant material such as quartz.

As noted, in this particular instance, the mounting frame 16 supports both the arc tube 14 and the shroud 20 within the lamp envelope 12. The mounting frame 16 includes a metal support rod 30 attached to lamp stem 24 by a strap 31. The support rod engages an inward projection 32 in the upper end of the lamp envelope 12 in the embodiment shown, although, as is known to those skilled in the art, other support systems can be used. The support rod 30 in its central portion is parallel to a central axis of the arc tube 14 and shroud 20. The mounting means 16 further includes a pair of clips 40, one mounted on each end of the shroud, which secure both arc tube 14 and shroud 20 to support rod 30. The clips 40 are attached to the support rod 30, preferably by welding.

It is with the latter clips that the invention pertains.

Referring now to FIGS. 3–6, there is shown a multi-functional shroud/arc tube support or clip 40*a* for a high intensity discharge lamp 10. The support 40*a* has one end 42 formed to engage a shroud 20. In the embodiment shown the one end 42 is formed as an arcuate member 43. A middle portion 44 is formed of separated, depending legs 46, 48 defining a space 50 therebetween for clasping the substantially rectangular pinch seal 52 of a quartz arc tube 14. The central section 53 is formed to clasp the cylindrical capillary 54 of a ceramic arc tube 14*a,* as shown in FIG. 2*b.* In the embodiment shown the central section 53 comprises the bight of a pair of U-shaped legs and the bights are provided with opposing, substantially hemi-cylindrical concavities 53*a.*

The support 40*a* can also be provided with projecting wings 60 for engaging the rod 30.

Figure 2A:
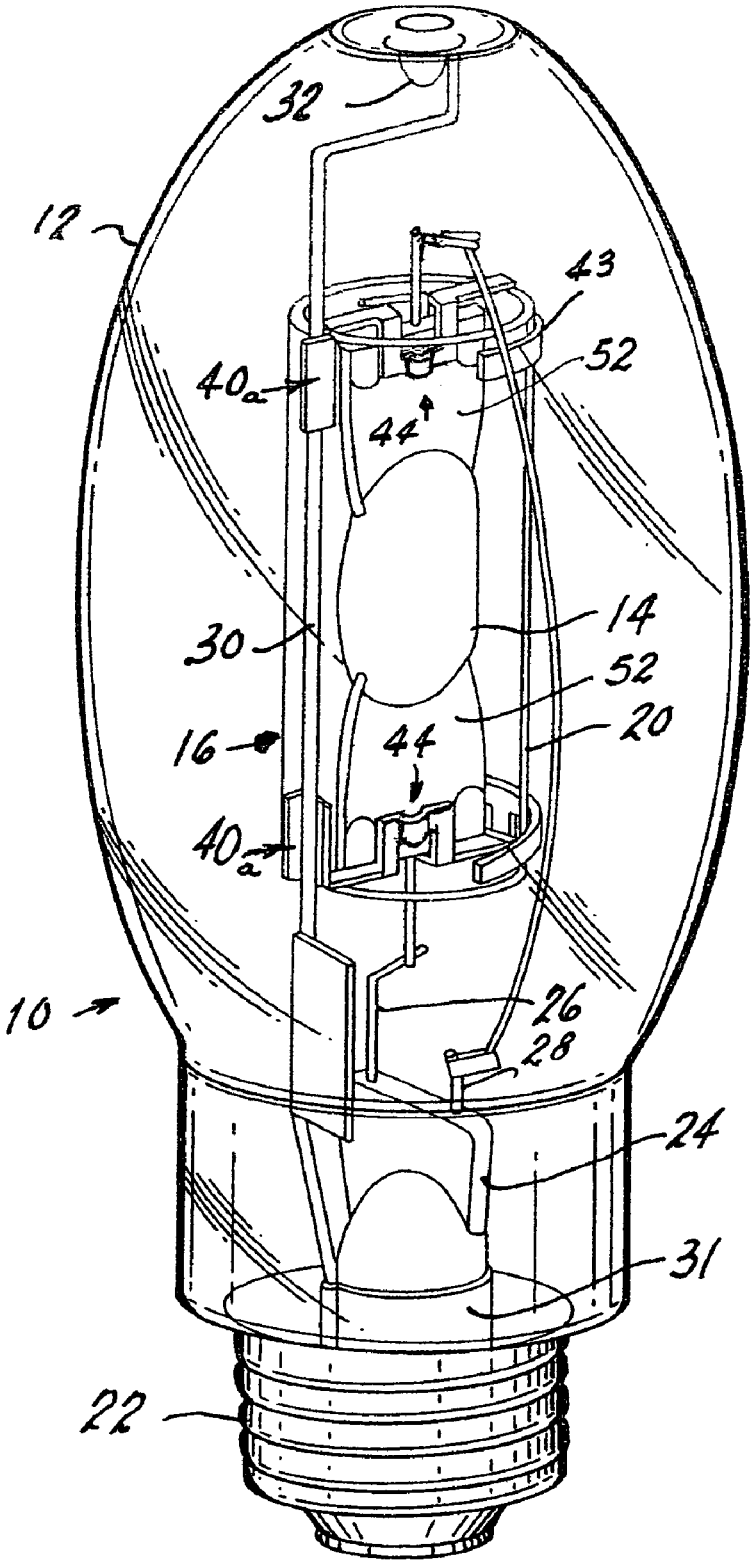
FIG. 2*a* is a perspective view of an embodiment of the invention employed with a quartz arc tube.
Figure 2B:
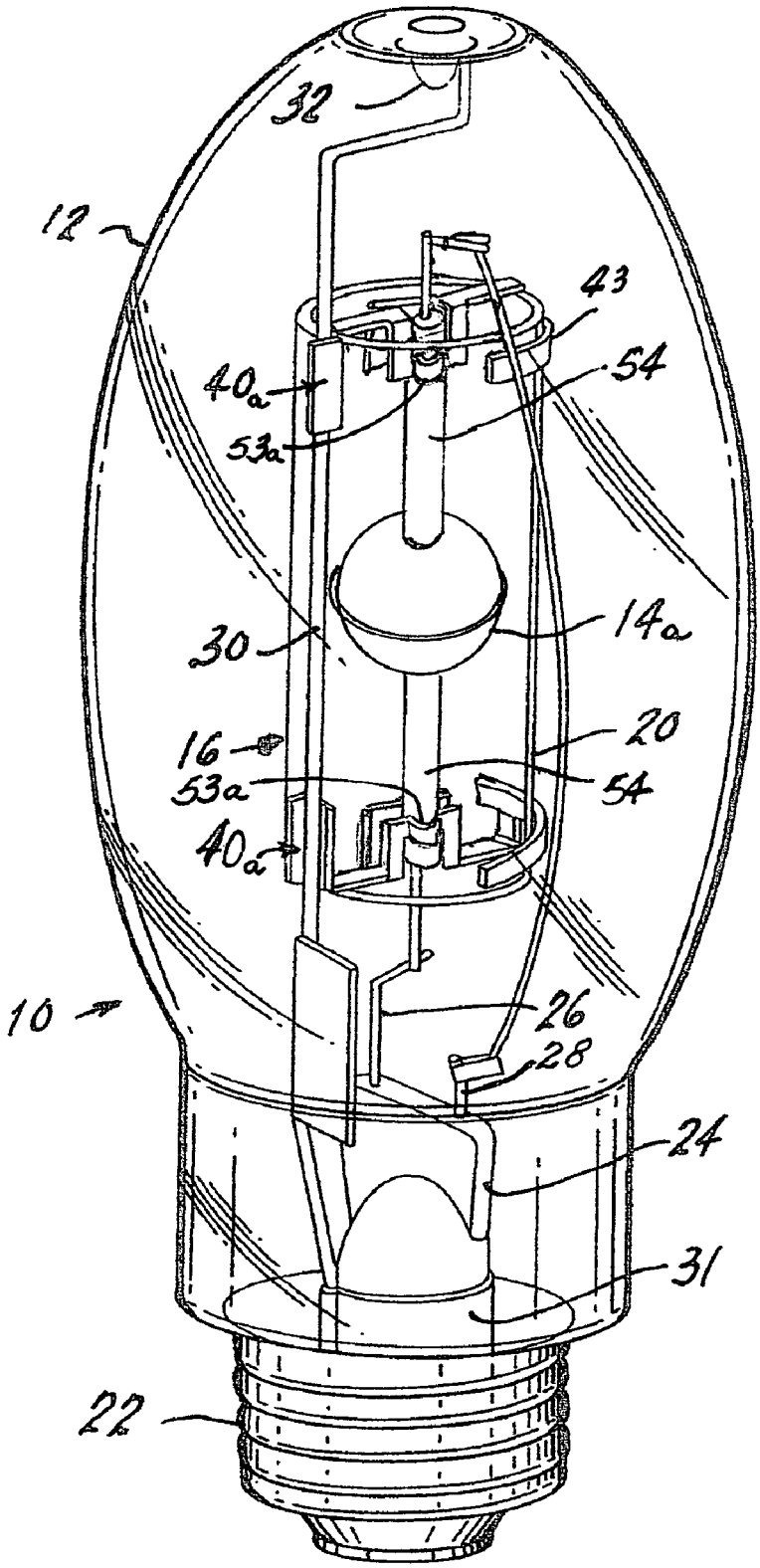
FIG. 2*b* is a perspective view of an embodiment of the invention employed with a ceramic arc tube.
Figure 3:
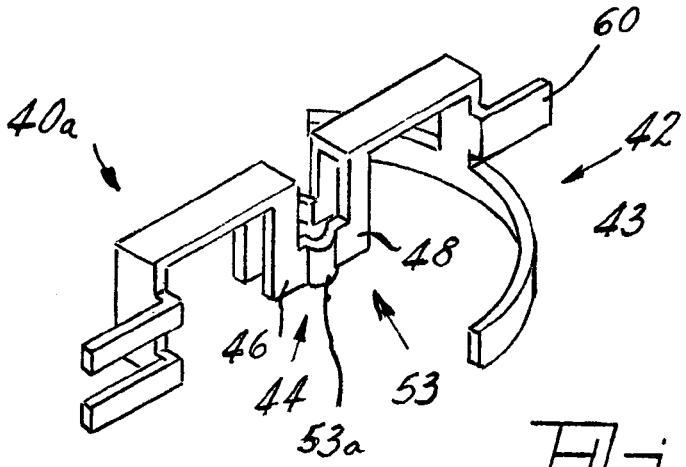
FIG. 3 is a perspective view of a support clip according to an embodiment of the invention.
Figure 4:
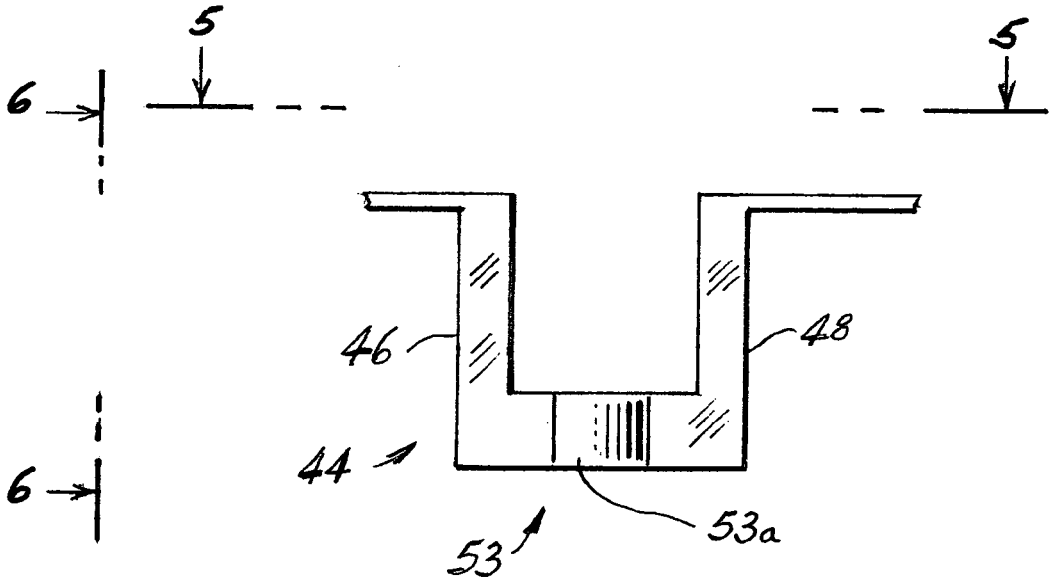
FIG. 4 is an elevational view of the clip of FIG. 3.
Figure 5:
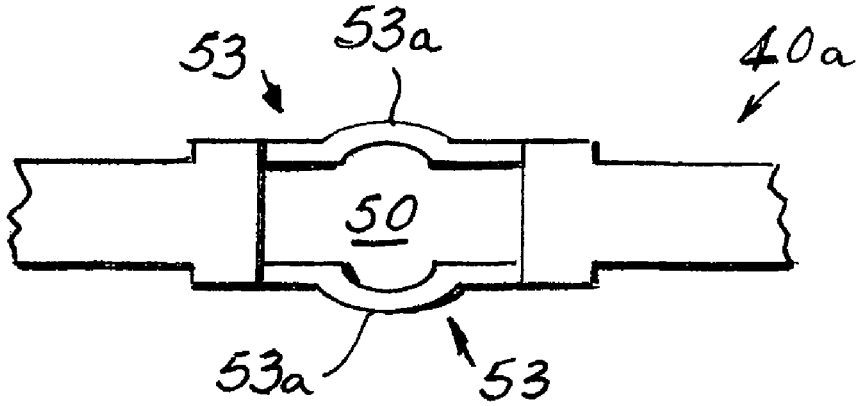
FIG. 5 is a plan view taken along the line 5—5 of FIG. 4.
Figure 6:
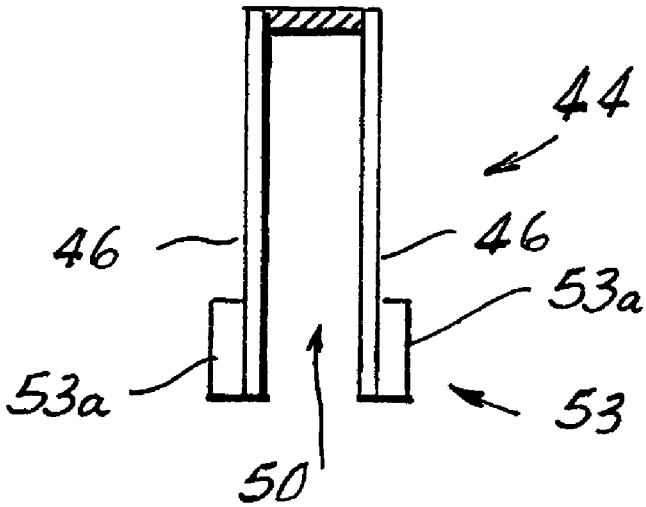
FIG. 6 is an end view taken along the line 6—6 of FIG. 4.

The support 40*a* can be easily employed with an arc tube having a pinch seal, such as a quartz arc tube 14 as shown in FIG. 2*a,* or with a ceramic arc tube 14*a* having extending, cylindrical capillaries 54, as shown in FIG. 2*b.* The single support that is usable with two distinct types of metal halide arc tubes greatly reduces inventory requirements and simplifies manufacture.

While there have been shown and described what are present considered to be the preferred embodiments of the invention, it will be apparent to those skilled in the art that various changes and modifications can be made herein without departing from the scope of the invention as defined by the appended claims.

What is claimed is:

1. A multi-functional shroud/arc tube support for a high intensity discharge lamp, said support comprising:

at least one end formed to engage a shroud; and a middle portion formed of separated, depending legs defining a space therebetween for clasping a substantially rectangular pinch seal of a quartz arc tube and having a central section formed to clasp a cylindrical capillary of a ceramic arc tube, said depending legs being two in number and substantially U-shaped and the bight of each U-shaped member being formed with a cylindrical concavity.

2. The multi-functional shroud/arc tube of claim 1 wherein each end of said support includes projecting wings for engaging frame members.

* * * * *